US011412913B2

(12) United States Patent
Zhao et al.

(10) Patent No.: US 11,412,913 B2
(45) Date of Patent: Aug. 16, 2022

(54) SPRAY ARM AND WASHING APPLIANCE HAVING SAME

(71) Applicants: FOSHAN SHUNDE MIDEA WASHING APPLIANCES MANUFACTURING CO., LTD., Foshan (CN); MIDEA GROUP CO., LTD., Foshan (CN)

(72) Inventors: Liming Zhao, Foshan (CN); Wangchun Fei, Foshan (CN); Haoping Xiong, Foshan (CN); Siqi Cai, Foshan (CN)

( * ) Notice: Subject to any disclaimer, the term of this patent is extended or adjusted under 35 U.S.C. 154(b) by 0 days.

(21) Appl. No.: 17/272,213

(22) PCT Filed: Jul. 1, 2019

(86) PCT No.: PCT/CN2019/094245
§ 371 (c)(1),
(2) Date: Feb. 26, 2021

(87) PCT Pub. No.: WO2020/042749
PCT Pub. Date: Mar. 5, 2020

(65) Prior Publication Data

US 2021/0315438 A1 Oct. 14, 2021

(30) Foreign Application Priority Data

Aug. 28, 2018 (CN) ..... 201810990350.5
Aug. 28, 2018 (CN) ..... 201821397611.4

(51) Int. Cl.
*A47L 15/23* (2006.01)
*A47L 15/42* (2006.01)

(52) U.S. Cl.
CPC ..... *A47L 15/23* (2013.01); *A47L 15/4282* (2013.01)

(58) Field of Classification Search
None
See application file for complete search history.

(56) References Cited

U.S. PATENT DOCUMENTS 5,449,011 A 9/1995 Jacobus et al.
2004/0069332 A1 4/2004 LeBaron

FOREIGN PATENT DOCUMENTS

CN 86203638 U 1/1987
CN 1269195 A 10/2000
CN 203987929 U 12/2014
CN 104739346 A 7/2015
DE 2064411 A1 7/1972
JP 2006020894 A 1/2006
KR 101445556 B1 10/2014

OTHER PUBLICATIONS

Search Report for EP application 19853578.3.

*Primary Examiner* — Levon J Shahinian
(74) *Attorney, Agent, or Firm* — Kilpatrick Townsend & Stockton, LLP

(57) ABSTRACT

Provided are a spray arm and a washing appliance having same. The spray arm comprises a main spray arm, a plurality of auxiliary spray arms and rolling ball assemblies, and each of the auxiliary spray arms is connected to the main spray arm, the auxiliary spray arms may rotate relative to the main spray arm, and the rolling ball assemblies are disposed at connecting and fitting parts between each of the auxiliary spray arms and the main spray arm.

18 Claims, 3 Drawing Sheets

SPRAY ARM AND WASHING APPLIANCE HAVING SAME

CROSS-REFERENCES TO RELATED APPLICATIONS

The present disclosure is a national phase application of International Application No. PCT/CN2019/094245, filed on Jul. 1, 2019, which claims priority to Chinese Patent Application Ser. Nos. 201810990350.5 and 201821397611.4, both filed on Aug. 28, 2018, the entire contents of which are incorporated herein by reference.

FIELD

The present disclosure relates to the field of household appliances, and more particularly to a spray arm and a washing appliance having same.

BACKGROUND

Currently, spray arms of most washing appliances rotate toward one direction and along a consistent cleaning trajectory, throughout the whole cleaning process, so it is easy to produce dead space. As an example, in a dishwasher, positions of a tableware basket and spray arms of the dishwasher are designed to match well. Designs of most existing tableware baskets are in accordance with the standard tableware design for the domestic market in China. During actual use by consumers in their own homes, if the size, placement, and orientation of the tableware are different from the standard tableware size and placement, the dishwasher will easily fail to clean well during work, which the consumers detest.

In order to improve the cleaning performance, some dishwashers employ satellite-type spray arms or water wall, but the structure of satellite-type spray arms or water wall is complicated and costly, which is not conducive to popularization.

SUMMARY

The present disclosure aims to solve at least one of the problems in the related art to a certain extent. To this end, the present disclosure provides a spray arm that has a simple structure and good cleaning performance when used to clean items.

The present disclosure further provides a washing appliance having the above spray arm.

A spray arm according to embodiments of the present disclosure includes a main spray arm; a plurality of auxiliary spray arms, each auxiliary spray arm being connected to the main spray arm and rotatable relative to the main spray arm; and a ball assembly arranged at a position where each auxiliary spray arm is connected to and cooperates with the main spray arm.

For the spray arm according to embodiments of the present disclosure, by providing the main spray arm and the plurality of auxiliary spray arms, which is equivalent to increasing the number of spray arms, a water spray volume of the spray arm can be increased, which is beneficial to enhancing the cleaning effect of the spray arm on the tableware. Moreover, since the auxiliary spray arms can rotate relative to the main spray arm, a spray range of the main spray arm and the auxiliary spray arms can be enlarged, ensuring that the spray arm can clean the tableware entirely. By providing the ball assemblies, the auxiliary spray arms and the main spray arm can be connected as a whole, ensuring high operational reliability of the spray arm.

According to some embodiments of the present disclosure, the main spray arm includes a main spray arm body and a plurality of main spray arm connecting sleeves, the plurality of main spray arm connecting sleeves are arranged on a common side of the main spray arm body, and each auxiliary spray arm is connected to the main spray arm through one main spray arm connecting sleeve.

Further, each auxiliary spray arm includes an auxiliary spray arm body and an auxiliary spray arm connecting sleeve, the auxiliary spray arm connecting sleeve is arranged on a side of the auxiliary spray arm body facing the main spray arm, and the ball assembly is arranged at a position where the auxiliary spray arm connecting sleeve is connected to and cooperates with the main spray arm connecting sleeve.

According to some embodiments of the present disclosure, the ball assembly at least includes a plurality of balls, and the plurality of balls rotatably cooperate between the auxiliary spray arm connecting sleeve and the main spray arm connecting sleeve.

Further, the ball assembly further includes a bearing base, and the balls cooperate between the auxiliary spray arm connecting sleeve and the main spray arm connecting sleeve through the bearing base.

In one embodiment, the bearing base includes: an inner sleeve configured to be fitted with one of the auxiliary spray arm connecting sleeve and the main spray arm connecting sleeve; a middle sleeve fitted over the inner sleeve, and provided with a plurality of ball holes, the balls being mounted in the ball holes, and the balls protruding beyond an inner peripheral surface and an outer peripheral surface of the middle sleeve in a radial direction of the middle sleeve; and an outer sleeve fitted over the middle sleeve, and configured to be fitted with the other of the auxiliary spray arm connecting sleeve and the main spray arm connecting sleeve.

In one embodiment, the bearing base includes: an inner sleeve configured to be fitted with one of the auxiliary spray arm connecting sleeve and the main spray arm connecting sleeve; and an outer sleeve configured to be fitted with the other of the auxiliary spray arm connecting sleeve and the main spray arm connecting sleeve.

According to some embodiments of the present disclosure, the inner sleeve is integrated with one of the auxiliary spray arm connecting sleeve and the main spray arm connecting sleeve, and the inner sleeve constitutes a part of the one of the auxiliary spray arm connecting sleeve and the main spray arm connecting sleeve; or the outer sleeve is integrated with the other of the auxiliary spray arm connecting sleeve and the main spray arm connecting sleeve, and the outer sleeve constitutes a part of the other of the auxiliary spray arm connecting sleeve and the main spray arm connecting sleeve.

According to some embodiments of the present disclosure, the inner sleeve is integrated with one of the auxiliary spray arm connecting sleeve and the main spray arm connecting sleeve, and the inner sleeve constitutes a part of the one of the auxiliary spray arm connecting sleeve and the main spray arm connecting sleeve; and the outer sleeve is integrated with the other of the auxiliary spray arm connecting sleeve and the main spray arm connecting sleeve, and the outer sleeve constitutes a part of the other of the auxiliary spray arm connecting sleeve and the main spray arm connecting sleeve.

Further, an inner peripheral surface of the outer sleeve is provided with an outer sleeve ball groove configured to cooperate with the balls; an outer peripheral surface of the inner sleeve is provided with an inner sleeve ball groove configured to cooperate with the balls; and the outer sleeve ball groove and the inner sleeve ball groove are both circumferentially annular grooves.

In one embodiment, the outer sleeve includes: an outer sleeve peripheral wall and an outer sleeve top wall; the outer sleeve top wall is arranged on an end of the outer sleeve peripheral wall away from the main spray arm and extends inwardly along a radial direction of the outer sleeve peripheral wall; and the outer sleeve ball groove is arranged on an inner peripheral surface of the outer sleeve peripheral wall.

In one embodiment, the ball hole is arranged at a top of the middle sleeve; the ball hole is a major arc hole; and a top notch of the ball hole forms a ball fetching port.

Further, a weakening groove is arranged between two adjacent ball holes, and the weakening groove is provided with a weakening groove post therein.

According to some embodiments of the present disclosure, the auxiliary spray arm includes a first spray arm and a second spray arm; the first spray arm is provided with a first drive hole configured to drive the first spray arm to rotate in a first direction; the second spray arm is provided with a second drive hole configured to drive the second spray arm to rotate in a second direction; the first direction and the second direction are consistent or opposite; and the main spray arm is provided with a main drive hole configured to drive the main spray arm to rotate in the first direction or the second direction.

In one embodiment, the length of the first spray arm is 0.5-1 times the length of the main spray arm body, and the length of the second spray arm is 0.5-1 times the length of the main spray arm body.

In one embodiment, the balls are plastic balls or stainless steel balls.

According to some embodiments of the present disclosure, the ball assembly has a height of 5 mm to 25 mm.

A washing appliance according to embodiments of another aspect of the present disclosure includes the above spray arm.

REFERENCE NUMERALS

Figure 1:
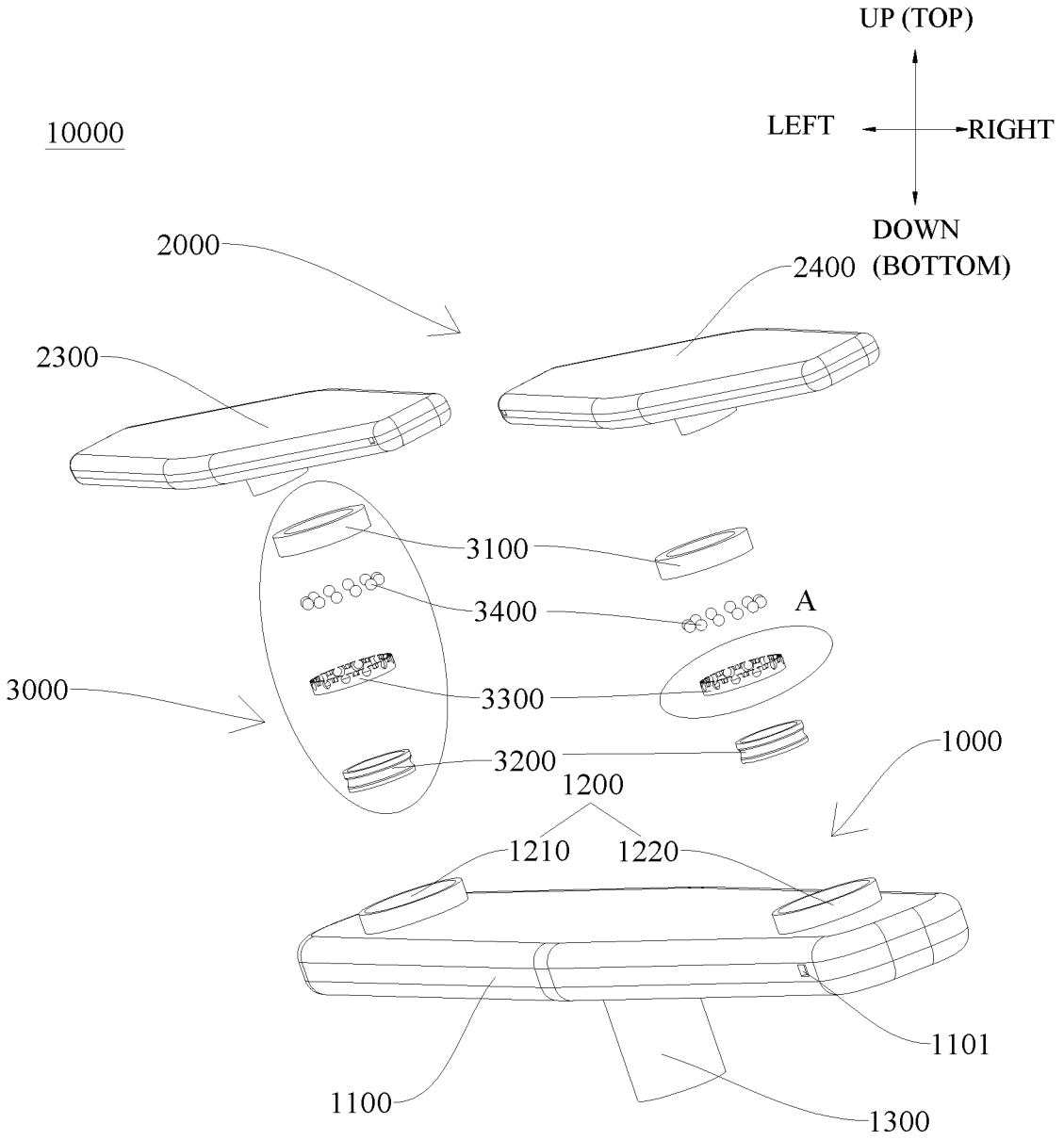
FIG. 1 is an exploded view of a spray arm.

Spray arm 10000, main spray arm 1000, main chamber 1001, main spray arm body 1100, main drive hole 1101, main spray arm connecting sleeve 1200, main spray arm first connecting sleeve 1210, main spray arm second connecting sleeve 1220, main spray arm lower connecting sleeve 1300, auxiliary spray arm 2000, auxiliary spray arm body 2100, auxiliary chamber 2101, auxiliary spray arm connecting sleeve 2200, first spray arm 2300, first chamber 2301, first spray arm connecting sleeve 2310, first spray arm body 2320, first drive hole 2321, second spray arm 2400, second chamber 2401, second spray arm connecting sleeve 2410, second spray arm body 2420, second drive hole 2421, ball assembly 3000, outer sleeve 3100, outer sleeve peripheral wall 3110, outer sleeve top wall 3120, outer sleeve ball groove 3130, inner sleeve 3200, inner sleeve ball groove 3210, middle sleeve 3300, ball hole 3310, weakening groove 3320, weakening groove post 3330, ball 3400.

DETAILED DESCRIPTION OF THE DISCLOSURE

Embodiments of the present disclosure will be described in detail below, and examples of the embodiments will be illustrated in drawings. The same or similar elements and the elements having same or similar functions are denoted by like reference numerals throughout the descriptions. The embodiments described herein with reference to the drawings are explanatory and are merely used to generally understand the present disclosure. The embodiments shall not be construed to limit the present disclosure.

In the description of the present disclosure, it is to be understood that terms such as "length," "width," "upper," "lower," "front," "rear," "left," "right," "vertical," "horizontal," "top," "bottom," "inner," and "outer" should be construed to refer to the orientations or positions as then described or as shown in the drawings under discussion. These relative terms are for convenience and simplification of description and do not indicate or imply that the device or element referred to must have a particular orientation or be constructed and operated in a particular orientation. Thus, these terms shall not be construed to limit the present disclosure.

In the description of the present disclosure, it should be noted that, unless specified or limited otherwise, the terms "mounted," "connected," "coupled," "fixed" and the like are used broadly, and may be, for example, fixed connections, detachable connections, or integral connections; may also be direct connections or indirect connections via intervening structures; may also be inner communication or mutual interaction of two elements.

A spray arm 10000 according to embodiments of the present disclosure will be described in detail below in combination with FIGS. 1 to 6. The spray arm 10000 can be used in washing appliances. The structure of the spray arm 10000 will be explained below by an example where the spray arm 10000 is applied to a dishwasher.

Referring to FIGS. 1, and 3-6, the spray arm 10000 according to the embodiments of the present disclosure may include a main spray arm 1000, a plurality of auxiliary spray arms 2000, and ball assemblies 3000. Each auxiliary spray arm 2000 is connected to the main spray arm 1000. When the spray arm 10000 is installed at a bottom of the dishwasher, the auxiliary spray arms 2000 are located above the main spray arm 1000. When the spray arm 10000 is installed at a top of the dishwasher, the auxiliary spray arms 2000 are located below the main spray arm 1000. When the spray arm 10000 is installed on a side wall of the dishwasher, the auxiliary spray arms 2000 are located on a side of the main spray arm 1000 facing an inner cavity of the dishwasher. For the convenience of description, the structure of the spray arm 10000 will be explained below by an example where the spray arm 10000 is installed at the bottom of the dishwasher, and in such a case, the main spray arm 1000 is a lower spray arm while the auxiliary spray arms 2000 are upper spray arms.

The main spray arm 1000 and the plurality of auxiliary spray arms 2000 are each provided with spray holes for spraying water into the dishwasher. When water sprayed from the spray holes falls on tableware, it can clean the tableware. The main spray arm 1000 and the plurality of auxiliary spray arms 2000 spray water simultaneously, which is beneficial to improving washing efficiency of the dishwasher.

The ball assembly 3000 is arranged between the main spray arm 1000 and the auxiliary spray arm 2000 to connect the main spray arm 1000 and the auxiliary spray arm 2000 as a whole. Thus, it is ensured that the main spray arm 1000 and the auxiliary spray arm 2000 can work simultaneously, which is beneficial to improving operational reliability of the spray arm 10000.

In one embodiment, the auxiliary spray arm 2000 is rotatable relative to the main spray arm 1000, which can increase a spray range of the main spray arm 1000 and the auxiliary spray arm 2000. Thus, it is ensured that the spray arm 10000 can clean the tableware entirely, guaranteeing a better cleaning effect of the spray arm 10000.

By providing the ball assembly 3000, when the auxiliary spray arm 2000 rotates relative to the main spray arm 1000, friction between the auxiliary spray arm 2000 and the main spray arm 1000 is in a form of rolling friction instead of sliding friction. In such a way, the rolling friction has little resistance to the rotation of the auxiliary spray arm 2000, so the hydrodynamic loss caused by friction can be reduced, and the utilization rate of hydrodynamic power can be improved. Meanwhile, since a rotation speed of the auxiliary spray arm 2000 with respect to the main spray arm 1000 is relatively fast, by providing the ball assembly 3000, it is helpful to enhance the smoothness of the main spray arm 1000 and the auxiliary spray arm 2000 during rotation, reducing the noise of the dishwasher.

In addition, the ball assembly 3000 is arranged between the main spray arm 1000 and the auxiliary spray arm 2000, and cleverly connects the main spray arm 1000 and the auxiliary spray arm 2000 as a whole. Moreover, the height of connection between the main spray arm 1000 and the auxiliary spray arm 2000 can be effectively reduced, thus reducing the height of the spray arm 10000, saving space inside the dishwasher, leaving more space for placement of the tableware, and hence increasing the tableware capacity of the dishwasher. In one embodiment, an internal loading capacity of the dishwasher can be increased by 10 mm to 40 mm.

In a specific embodiment, rotation directions of the auxiliary spray arms 2000 can be consistent or different. In one embodiment, a rotation direction of some auxiliary spray arms 2000 is opposite to a rotation direction of other auxiliary spray arms 2000. In such a way, water jets from these auxiliary spray arms 2000 can produce a rubbing force on surfaces of the tableware, which helps to further improve the cleaning effect. A rotation direction of the main spray arm 1000 may be consistent with or opposite to a rotation direction of an auxiliary spray arm 2000. In some embodiments, the rotation directions of the auxiliary spray arms 2000 are the same, and the rotation directions of the main spray arm 1000 and the auxiliary spray arms 2000 are opposite. Therefore, the water jets from the main spray arm 1000 and the auxiliary spray arms 2000 can produce a rubbing force on surfaces of the tableware, which also helps to improve the cleaning effect. Orientations and positions of the water jets sprayed onto the tableware by the auxiliary spray arms 2000 are various, which reduces dead spots and makes cleaning easier. Due to a large coverage of the water flow, the cleaning time will be reduced accordingly, which is beneficial to shortening the cleaning process.

In a specific example of FIG. 1, the number of auxiliary spray arms 2000 is two. In one embodiment, rotation directions of the two auxiliary spray arms 2000 are opposite, and the rotation direction of the main spray arm 1000 is the same as the rotation direction of one auxiliary spray arm 2000.

For the spray arm 10000 according to the embodiments of the present disclosure, by providing the main spray arm 1000 and the plurality of auxiliary spray arms 2000, which is equivalent to increasing the number of spray arms 10000, a water spray volume of the spray arm 10000 can be increased, which is beneficial to enhancing the cleaning effect of the spray arm 10000 on the tableware. Moreover, since the auxiliary spray arms 2000 can rotate relative to the main spray arm 1000, a spray range of the main spray arm 1000 and the auxiliary spray arms 2000 can be enlarged, and the water jets from the main spray arm 1000 and the auxiliary spray arms 2000 can generate the rubbing force on the surfaces of the tableware, ensuring that the spray arm 10000 can clean the tableware entirely. By arranging the ball assemblies 3000 between the main spray arm 1000 and the auxiliary spray arms 2000, the auxiliary spray arms 2000 and the main spray arm 1000 are connected as a whole, ensuring high operational reliability of the spray arm 10000; moreover, the main spray arm 1000 and the auxiliary spray arms 2000 have rolling contact there between, which is beneficial to reducing the friction between the auxiliary spray arms 2000 and the main spray arm 1000 and hence the hydrodynamic loss, and improving the utilization rate of hydrodynamic power. Hence, it can be ensured that the pressure of water sprayed from the spray holes of the spray arm 10000 is large, which helps to improving the cleaning effect of the dishwasher on the tableware. Meanwhile, since the main spray arm 1000 and the auxiliary spray arms 2000 are connected by the ball assemblies 3000, the height of the spray arm 10000 can be decreased effectively, saving the internal space of the dishwasher and leaving more space for the tableware, to increase the tableware capacity of the dishwasher.

Referring to FIGS. 1 and 3-5, the main spray arm 1000 may include a main spray arm body 1100 and a plurality of main spray arm connecting sleeves 1200, and the plurality of main spray arm connecting sleeves 1200 are arranged on a common side of the main spray arm body 1100. As shown in FIG. 1, the plurality of main spray arm connecting sleeves 1200 are all arranged above the main spray arm body 1100, and the plurality of main spray arm connecting sleeves 1200 are fixedly connected to the main spray arm body 1100. Each auxiliary spray arm 2000 is connected to the main spray arm 1000 through one main spray arm connecting sleeve 1200. Each main spray arm connecting sleeve 1200 has a hollow cylindrical structure. Therefore, by providing the main spray arm connecting sleeves 1200, it is ensured that the auxiliary spray arms 2000 can rotate relative to the main spray arm 1000.

Figure 5:
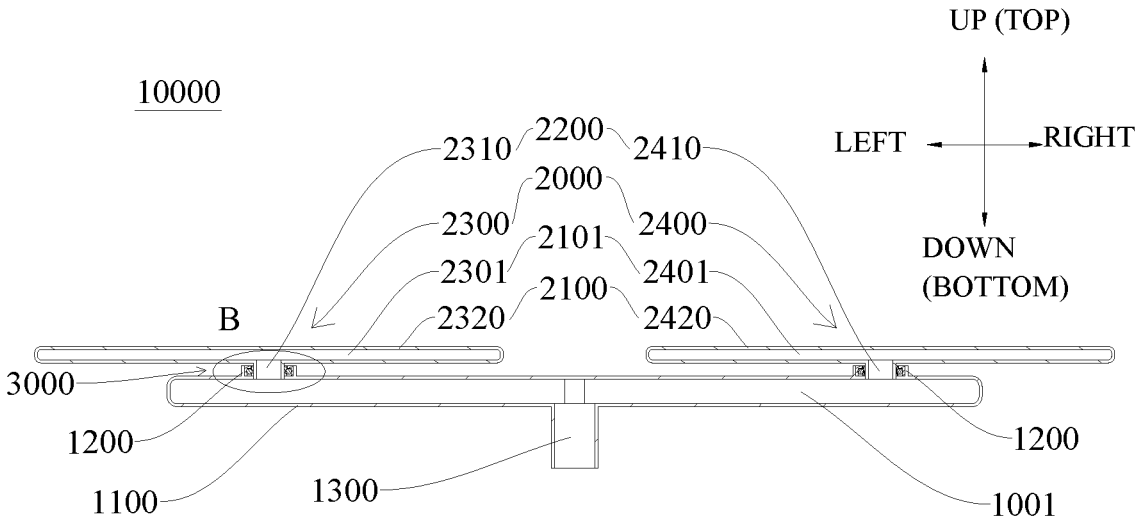
FIG. 5 is a front view of a cross section of a spray arm.

As shown in FIG. 5, the main spray arm body 1100 and the plurality of main spray arm connecting sleeves 1200 have a communicating main chamber 1001. The main spray arm body 1100 and the plurality of main spray arm connecting sleeves 1200 may be hollow components. Hollow positions of the spray arm body 1100 and the main spray arm connecting sleeves 1200 together form the main chamber 1001, so that it is ensured that water from a water source of the dishwasher can smoothly enter the main spray arm 1000, then pass through the spray holes of the main spray arm 1000 and is sprayed to the surfaces of the tableware, completing an operation of washing the tableware. Therefore, by providing the main chamber 1001, it can be ensured that an amount of water exists in the main spray arm 1000, and hence that the main spray arm 1000 can spray water jets to the tableware, to ensure the reliable operation of the main spray arm 1000.

As shown in FIGS. 1 and 3-5, the main spray arm 1000 may also include a main spray arm lower connecting sleeve 1300 arranged on a lower side of the main spray arm body 1100. In one embodiment, a top of the main spray arm lower connecting sleeve 1300 is fixedly connected to a bottom of the main spray arm body 1100. A bottom of the main spray arm lower connecting sleeve 1300 can be connected to an inner container of the dishwasher or can be connected to a spray arm base. Water from the water source can enter the main chamber 1001 through the main spray arm lower connecting sleeve 1300. In other words, a cavity within the main spray arm lower connecting sleeve 1300 is a part of the main chamber 1001, that is, the main spray arm lower connecting sleeve 1300 is also a hollow component, which can ensure that the water from the water source can smoothly enter the main chamber 1001.

Figure 4:
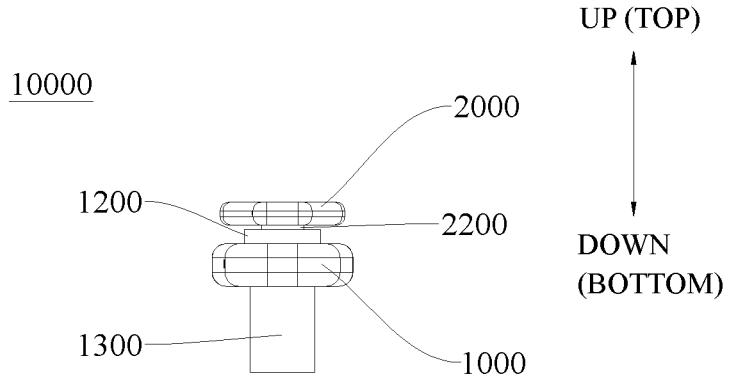
FIG. 4 is a left view of a spray arm.

Further, referring to FIGS. 1 and 4-5, each auxiliary spray arm 2000 may include an auxiliary spray arm body 2100 and an auxiliary spray arm connecting sleeve 2200, and the auxiliary spray arm connecting sleeve 2200 is arranged on a side of the auxiliary spray arm body 2100 facing the main spray arm 1000. That is, the auxiliary spray arm connecting sleeve 2200 is located below the auxiliary spray arm body 2100, and the auxiliary spray arm connecting sleeve 2200 is fixedly connected to the auxiliary spray arm body 2100.

During production, the main spray arm body 1100, the main spray arm connecting sleeve 1200, and the main spray arm lower connecting sleeve 1300 can be integrally formed; and the auxiliary spray arm body 2100 and the auxiliary spray arm connecting sleeve 2200 can also be integrally formed, simplifying an assembling process and saving assembling time. In some embodiments (not illustrated), the main spray arm body 1100, the main spray arm connecting sleeve 1200, and the main spray arm lower connecting sleeve 1300 may be detachably connected; and the auxiliary spray arm body 2100 and the auxiliary spray arm connecting sleeve 2200 can also be detachably connected.

As shown in FIG. 5, the auxiliary spray arm body 2100 and the auxiliary spray arm connecting sleeve 2200 have a communicating auxiliary chamber 2101. The auxiliary spray arm body 2100 and the auxiliary spray arm connecting sleeve 2200 may both be hollow components, and hollow positions of the two components together form the auxiliary chamber 2101. By providing the auxiliary chamber 2101, it can be ensured that an amount of water exists in the auxiliary spray arm 2000, and hence that the auxiliary spray arm 2000 can spray water jets to the tableware, to ensure the reliable operation of the auxiliary spray arm 2000. The auxiliary spray arm connecting sleeve 2200 has a hollow cylindrical structure to ensure relative rotation between the auxiliary spray arm connecting sleeve 2200 and the main spray arm connecting sleeve 1200.

As shown in FIG. 5, the auxiliary chamber 2101 is also in communication with the main chamber 1001 to ensure that the water in the main chamber 1001 can flow into the auxiliary chamber 2101. In a specific embodiment, after the spray arm 10000 is connected to the water source of the dishwasher, water from the water source of the dishwasher first enters the main chamber 1001 through the main spray arm lower connecting sleeve 1300 and at this time, the water in the main chamber 1001 is sprayed out through the spray holes, cleaning an inner wall of the dishwasher or the tableware. In such a case, as the water from the water source continues entering the main chamber 1001, the water from the water source gradually fills the main chamber 1001, and the water pressure in the main chamber 1001 becomes greater and greater. At this time, the water in the main spray arm body 1100 will enter the auxiliary spray arm body 2100 through the main spray arm connecting sleeve 1200 or the auxiliary spray arm connecting sleeve 2200, that is, the water in the main chamber 1001 will enter the auxiliary chamber 2101. At this time, the water in the auxiliary chamber 2101 is also sprayed out to clean the inner wall of the dishwasher or the tableware. Therefore, by communicating the auxiliary chamber 2101 with the main chamber 1001, it is ensured that the main spray arm 1000 and the auxiliary spray arm 2000 can work normally, and the main spray arm 1000 and the auxiliary spray arm 2000 spray water together, which is beneficial to increasing the water spray volume, improving the cleaning effect.

Figure 6:
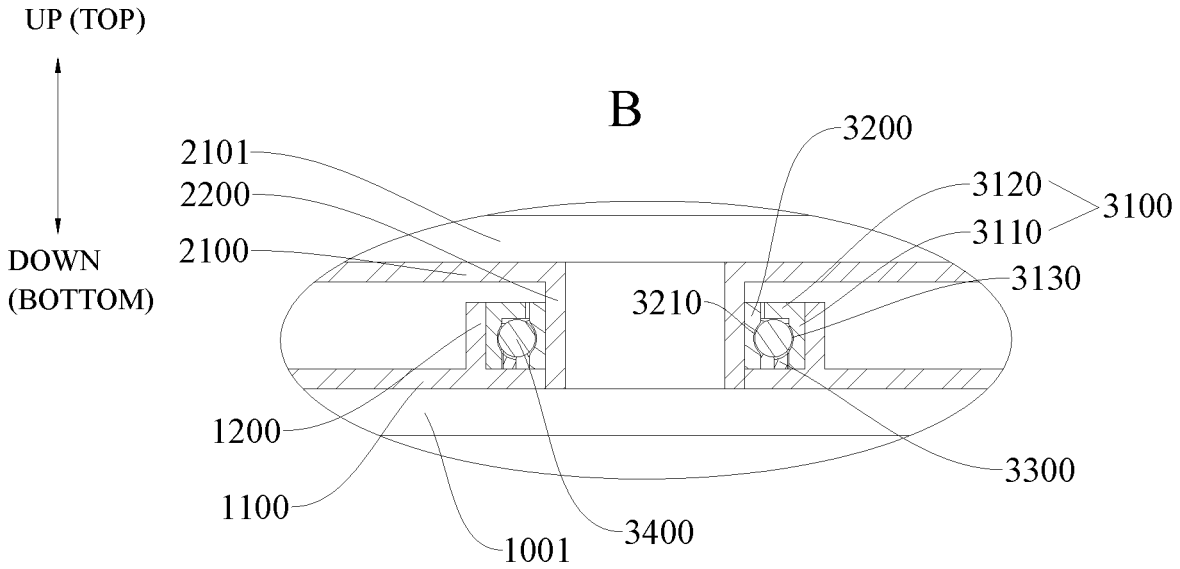
FIG. 6 is a partially enlarged view of part B in FIG. 5.

As shown in FIGS. 1 and 5-6, the ball assembly 3000 is provided at a position where the auxiliary spray arm connecting sleeve 2200 is connected to and cooperates with the main spray arm connecting sleeve 1200. Since the ball assembly 3000 is arranged between the main spray arm connecting sleeve 1200 and the auxiliary spray arm connecting sleeve 2200, the main spray arm connecting sleeve 1200 and the auxiliary spray arm connecting sleeve 2200 are connected as a whole, and hence the main spray arm 1000 and the auxiliary spray arm 2000 are connected as a whole, which can ensure reliable connection between the main spray arm 1000 and the auxiliary spray arm 2000, without hindering the relative rotation of the main spray arm 1000 and the auxiliary spray arm 2000, to guarantee the high operational reliability of the spray arm 10000. In some embodiments of the present disclosure, the ball assembly 3000 at least includes a plurality of balls 3400, and the plurality of balls 3400 rotatably cooperate between the auxiliary spray arm connecting sleeve 2200 and the main spray arm connecting sleeve 1200.

Further, the ball assembly 3000 further includes: a bearing base through which the balls 3400 cooperate between the auxiliary spray arm connecting sleeve 2200 and the main spray arm connecting sleeve 1200.

In one embodiment, the bearing base includes: an inner sleeve 3200, a middle sleeve 3300, and an outer sleeve 3100. The inner sleeve 3200 is configured to be fitted with one of the auxiliary spray arm connecting sleeve 2200 and the main spray arm connecting sleeve 1200. The middle sleeve 3300 is fitted over the inner sleeve 3200. The middle sleeve 3300 is provided with a plurality of ball holes 3310, and the balls 3400 are installed in the ball holes 3310. The balls 3400 protrude beyond an inner peripheral surface and an outer peripheral surface of the middle sleeve 3300 in a radial direction of the middle sleeve 3300. The outer sleeve 3100 is fitted over the middle sleeve 3300, and the outer sleeve 3100 is configured to be fitted with the other of the auxiliary spray arm connecting sleeve 2200 and the main spray arm connecting sleeve 1200.

In one embodiment, the bearing base includes: an inner sleeve 3200 and an outer sleeve 3100. The inner sleeve 3200 is configured to be fitted with one of the auxiliary spray arm connecting sleeve 2200 and the main spray arm connecting sleeve 1200, while the outer sleeve 3100 is configured to be fitted with the other of the auxiliary spray arm connecting sleeve 2200 and the main spray arm connecting sleeve 1200.

In some embodiments of the present disclosure, the inner sleeve 3200 is integrated with one of the auxiliary spray arm connecting sleeve 2200 and the main spray arm connecting sleeve 1200, so that the inner sleeve 3200 constitutes a part of the one of the auxiliary spray arm connecting sleeve 2200 and the main spray arm connecting sleeve 1200; or the outer sleeve 3100 is integrated with the other of the auxiliary spray arm connecting sleeve 2200 and the main spray arm connecting sleeve 1200, so that the outer sleeve 3100 constitutes a part of the other of the auxiliary spray arm connecting sleeve 2200 and the main spray arm connecting sleeve 1200.

In some embodiments of the present disclosure, the inner sleeve 3200 is integrated with one of the auxiliary spray arm connecting sleeve 2200 and the main spray arm connecting sleeve 1200, so that the inner sleeve 3200 constitutes a part of the one of the auxiliary spray arm connecting sleeve 2200 and the main spray arm connecting sleeve 1200; and the outer sleeve 3100 is integrated with the other of the auxiliary spray arm connecting sleeve 2200 and the main spray arm connecting sleeve 1200, so that the outer sleeve 3100 constitutes a part of the other of the auxiliary spray arm connecting sleeve 2200 and the main spray arm connecting sleeve 1200.

It should be noted that the inner sleeve 3200 being integrated with one of the auxiliary spray arm connecting sleeve 2200 and the main spray arm connecting sleeve 1200 may be that the inner sleeve 3200 is integrated with the auxiliary spray arm connecting sleeve 2200, that is, the inner sleeve 3200 constitutes a part of the auxiliary spray arm connecting sleeve 2200, and the main spray arm connecting sleeve 1200 is fitted over the auxiliary spray arm connecting sleeve 2200, the ball assembly 3000 does not include the inner sleeve 3200, and inner sides of the balls 3400 are in direct rolling contact with the auxiliary spray arm connecting sleeve 2200. It is also possible that the inner sleeve 3200 is integrated with the main spray arm connecting sleeve 1200, that is, the inner sleeve 3200 constitutes a part of the main spray arm connecting sleeve 1200, and the auxiliary spray arm connecting sleeve 2200 is fitted over the main spray arm connecting sleeve 1200, the ball assembly 3000 does not include the inner sleeve 3200, and inner sides of the ball 3400 are in direct rolling contact with the main spray arm connecting sleeve 1200.

Similarly, the outer sleeve 3100 being integrated with the other of the auxiliary spray arm connecting sleeve 2200 and the main spray arm connecting sleeve 1200 may be that the outer sleeve 3100 is integrated with the main spray arm connecting sleeve 1200, that is, the outer sleeve 3100 constitutes a part of the main spray arm connecting sleeve 1200, and the main spray arm connecting sleeve 1200 is fitted over the auxiliary spray arm connecting sleeve 2200, the ball assembly 3000 does not include the outer sleeve 3100, and outer sides of the balls 3400 are in direct rolling contact with the main spray arm connecting sleeve 1200. It is also possible that the outer sleeve 3100 is integrated with the auxiliary spray arm connecting sleeve 2200, that is, the outer sleeve 3100 constitutes a part of the auxiliary spray arm connecting sleeve 2200, and the auxiliary spray arm connecting sleeve 2200 is fitted over the main spray arm connecting sleeve 1200, the ball assembly 3000 does not include the outer sleeve 3100, and outer sides of the balls 3400 are in direct rolling contact with the auxiliary spray arm connecting sleeve 2200.

The structure of the ball assembly 3000 will be described below by an example where the main spray arm connecting sleeve 1200 is fitted over the auxiliary spray arm connecting sleeve 2200.

In an embodiment shown in FIGS. 1 and 5-6, the ball assembly 3000 may include: an outer sleeve 3100, an inner sleeve 3200, a middle sleeve 3300, and balls 3400. The outer sleeve 3100, the inner sleeve 3200, and the middle sleeve 3300 may all be ring members. The inner sleeve 3200 is arranged inside the outer sleeve 3100, and the middle sleeve 3300 is arranged between the outer sleeve 3100 and the inner sleeve 3200. That is, in an inward direction of the ball assembly 3000, the outer sleeve 3100, the middle sleeve 3300 and the inner sleeve 3200 are arranged in sequence. The main spray arm connecting sleeve 1200 is fitted over a periphery of the auxiliary spray arm connecting sleeve 2200. The outer sleeve 3100 can be fixedly connected to the main spray arm connecting sleeve 1200. The inner sleeve 3200 can be fixedly connected to the auxiliary spray arm connecting sleeve 2200. The balls 3400 are arranged in the middle sleeve 3300, and the balls 3400 can rotate in the middle sleeve 3300 relative to the outer sleeve 3100 and the inner sleeve 3200, to ensure that the inner sleeve 3200 can rotate relative to the outer sleeve 3100, and hence guarantee that the auxiliary spray arm 2000 can rotate relative to the main spray arm 1000.

The balls 3400 protrude beyond the inner peripheral surface and the outer peripheral surface of the middle sleeve 3300 in the radial direction of the middle sleeve 3300. That is, a diameter of each ball 3400 is larger than a wall thickness of the middle sleeve 3300, and the ball 3400 is only partially arranged in the middle sleeve 3300. In a specific embodiment, a part of the ball 3400 protruding beyond the inner peripheral surface of the middle sleeve 3300 can be in rolling contact with an outer surface of the inner sleeve 3200, and a part of the ball 3400 protruding beyond the outer peripheral surface of the middle sleeve 3300 can be in rolling contact with an inner surface of the outer sleeve 3100. Since the inner sleeve 3200 is fixedly connected to the auxiliary spray arm connecting sleeve 2200 and the outer sleeve 3100 is fixedly connected to the main spray arm connecting sleeve 1200, indirect connection between the main spray arm 1000 and the auxiliary spray arm 2000 can be achieved through the ball assembly 3000, and the main spray arm 1000, the auxiliary spray arm 2000 and the ball assembly 3000 have a simple and stable connection structure.

When the auxiliary spray arm 2000 rotates relative to the main spray arm 1000, the balls 3400 roll to allow relative rotation between the inner sleeve 3200 and the outer sleeve 3100; and since the main spray arm 1000 is fixedly connected to the outer sleeve 3100 and the auxiliary spray arm 2000 is fixedly connected to the inner sleeve 3200, relative rotation between the auxiliary spray arm 2000 and the main spray arm 1000 can be realized.

Figure 2:
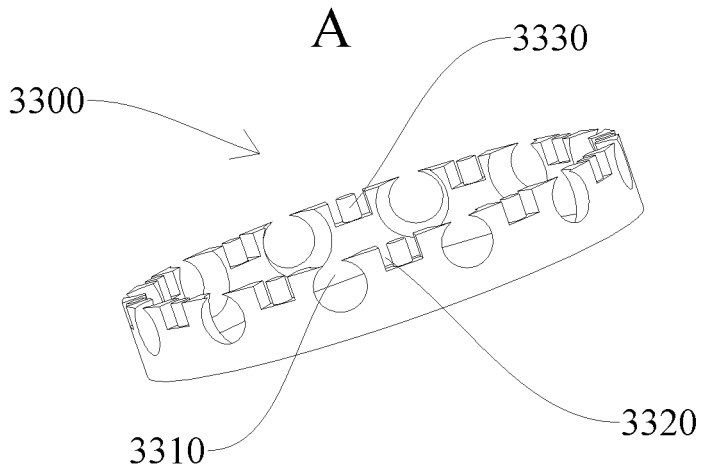
FIG. 2 is a partially enlarged view of part A in FIG. 1.

In one embodiment, as shown in FIGS. 2 and 6, the middle sleeve 3300 is provided with a plurality of ball holes 3310, and the balls 3400 are rotatably installed in the ball holes 3310. The ball holes 3310 provide support for the fixation of the balls 3400 to ensure that relative positions of the plurality of balls 3400 remain unchanged, which can prevent collision and squeezing among the plurality of balls 3400, improving the working stability of the ball assembly 3000. In one embodiment, the number of balls 3400 is identical to the number of ball holes 3310.

In a specific embodiment, a plurality of balls 3400 are provided and can be evenly distributed along a circumferential direction of the middle sleeve 3300, improving the stability of the main spray arm 1000 and the auxiliary spray arm 2000 during rotation. In one embodiment, the number of balls 3400 is an even number, thus ensuring a balanced force on the ball assembly 3000 and relieving a stress concentration phenomenon In one embodiment, the diameter of the ball 3400 is 3 mm to 8 mm, and the number of the ball 3400 is four to twelve.

By providing the ball assembly 3000, it is ensured that the friction is small when the auxiliary spray arm 2000 rotates relative to the main spray arm 1000, which helps to improve the smoothness of the main spray arm 1000 and the auxiliary spray arm 2000 during the rotation, and reduce the noise of the dishwasher.

The middle sleeve 3300 has three main functions. First, by providing the ball holes 3310 on the middle sleeve 3300 and installing the balls 3400 in the ball holes 3310, the positions of the balls 3400 can be fixed and limited to prevent accumulation of the balls 3400. Second, food residues can be isolated and prevented from entering ball grooves, which may otherwise cause friction. Third, the middle sleeve can play a strengthening role, and can isolate vibration of the auxiliary spray arm 2000 to prevent the spray arm 10000 from shaking seriously.

Further, referring to FIGS. 1 and 6, an inner peripheral surface of the outer sleeve 3100 is provided with an outer sleeve ball groove 3130 configured to cooperate with the balls 3400, and an outer peripheral surface of the inner sleeve 3200 is provided with an inner sleeve ball groove 3210 configured to cooperate with the balls 3400. The outer sleeve ball groove 3130 and the inner sleeve ball groove 3210 are both circumferentially annular grooves, which can ensure the smooth rotation of the auxiliary spray arm 2000 relative to the main spray arm 1000. Meanwhile, the ball assembly 3000 is an independent modular component, which is easy to mount and dismount, and also reduces processing costs of the auxiliary spray arm 2000 or the main spray arm 1000. The balls 3400 are in rolling contact with the outer sleeve ball groove 3130 and the inner sleeve ball groove 3210, and the friction is small. In a specific embodiment, a diameter of the outer sleeve ball groove 3130 and a diameter of the inner sleeve ball groove 3210 may be equal to the diameter of the ball 3400, or may be slightly larger than the diameter of the ball 3400, ensuring that the ball 3400 can well cooperate with the outer sleeve ball groove 3130 and the inner sleeve ball groove 3210.

In combination with FIG. 6, in a direction of a central axis of the main spray arm connecting sleeve 1200, positions of the outer sleeve ball groove 3130, the inner sleeve ball groove 3210, and the ball hole 3310 correspond to each other, and the ball 3400 is partially arranged in the ball hole 3310. An outer side of the ball 3400 is in contact with the outer sleeve ball groove 3130, and an inner side of the ball 3400 is in contact with the inner sleeve ball groove 3210, completing indirect connection between the outer sleeve 3100 and the inner sleeve 3200. Moreover, since the positions of the outer sleeve ball groove 3130, the inner sleeve ball groove 3210, and the ball hole 3310 correspond to each other, it is possible to avoid a situation that a sliding trajectory of the ball 3400 when the auxiliary spray arm 2000 rotates relative to the main spray arm 1000 is different from trajectories of the outer sleeve ball groove 3130 and the inner sleeve ball groove 3210 and thus the ball is squeezed, causing the auxiliary spray arm 2000 to fail to rotate.

In one embodiment, the outer sleeve 3100 may include: an outer sleeve peripheral wall 3110 and an outer sleeve top wall 3120. The outer sleeve top wall 3120 is arranged on an end of the outer sleeve peripheral wall 3110 away from the main spray arm 1000. As shown in FIG. 6, the outer sleeve top wall 3120 is arranged at an upper end of the outer sleeve peripheral wall 3110, and extends inwardly along a radial direction of the outer sleeve peripheral wall 3110. That is, half of a cross section of the outer sleeve 3100 exhibits an inverted L-shape. moreover, an inner diameter of the outer sleeve top wall 3120 is slightly larger than an outer diameter of the inner sleeve 3200, to ensure that when the outer sleeve 3100 and the inner sleeve 3200 rotate relative to each other, the outer sleeve 3100 is not in contact with the inner sleeve 3200, ensuring normal rotation of the main spray arm 1000 and the auxiliary spray arm 2000. Furthermore, the outer sleeve top wall 3120 is located above the ball 3400, which can play a shielding role for the ball 3400 to prevent residues in the dishwasher from entering the ball assembly 3000 and obstructing normal working of the ball assembly 3000, and which can also prevent the ball 3400 from slipping out of the ball assembly 3000. The outer sleeve ball groove 3130 is arranged on an inner peripheral surface of the outer sleeve peripheral wall 3110, to ensure that the ball 3400 can roll along the outer sleeve ball groove 3130, guaranteeing the high operational reliability of the ball assembly 3000.

In one embodiment, the ball hole 3310 is arranged at a top of the middle sleeve 3300; the ball hole 3310 is a major arc hole; and a top notch of the ball hole 3310 forms a ball fetching port. The ball 3400 enters the ball hole 3310 or exits from the ball hole 3310 through the ball fetching port, which can facilitate installation and detachment of the ball 3400 in and from the ball hole 3310. The major arc hole is a hole with a central angle greater than 180° and less than 360°, so that each ball 3400 can be mostly located in the ball hole 3310 to prevent the ball 3400 from falling out of the ball hole 3310 after installation. When the ball 3400 is installed, the ball fetching port can be expanded with the help of external force, and then the ball 3400 is installed in the ball hole 3310 through the ball fetching port. Then, as the external force is removed, elastic deformation of the ball hole 3310 disappears, and the ball hole 3310 is restored into its original shape. At this time, the ball hole 3310 tightly wraps the ball 3400, so that the installation of the ball 3400 in the ball hole 3310 is firmer and more reliable.

Further, a weakening groove 3320 is provided between two adjacent ball holes 3310. By providing the weakening groove 3320, the rigidity between the two adjacent ball holes 3310 can be made smaller. Therefore, when the ball 3400 is installed, the ball hole 3310 is easily deformed, reducing the difficulty of mounting or dismounting the ball 3400.

The weakening groove 3320 is provided with a weakening groove post 3330. In one embodiment, a central axis of the weakening groove post 3330 is parallel to a central axis of the middle sleeve 3300, which is beneficial to simplifying the processing technique of the middle sleeve 3300. By providing the weakening groove column 3330, a strengthening effect can be achieved, to prevent the weakening groove 3320 from excessively weakening the rigidity of the middle sleeve 3300, helping to improve the working reliability of the ball assembly 3000.

In some embodiments (not illustrated), the ball hole 3310 can also be arranged in a middle position of the middle sleeve 3300. At this time, the ball hole 3310 is a round hole penetrating the wall thickness of the middle sleeve 3300.

In one embodiment, the balls 3400 are plastic balls 3400 or stainless steel balls 3400, because a working environment of the spray arm 10000 is full of water, and the spray arm 10000 is in a warm and humid environment for a long time, which will easily cause the ball 3400 to rust and jam. The plastic balls 3400 or stainless steel balls 3400 have a strong anti-corrosion ability, which can effectively slow down or even avoid the rust of the ball 3400.

In one embodiment, the outer sleeve 3100 is installed inside the main spray arm connecting sleeve 1200, and an inner diameter of the main spray arm connecting sleeve 1200 is equal to an outer diameter of the outer sleeve 3100. In one embodiment, the main spray arm connecting sleeve 1200 is in interference fit with the outer sleeve 3100, to ensure that the outer sleeve 3100 can be firmly fixed in the main spray arm connecting sleeve 1200, guaranteeing the reliable connection between the ball assembly 3000 and the main spray arm 1000. Similarly, the inner sleeve 3200 is fitted over the auxiliary spray arm connecting sleeve 2200, and an outer diameter of the auxiliary spray arm connecting sleeve 2200 is equal to an inner diameter of the inner sleeve 3200. In one embodiment, the auxiliary spray arm connecting sleeve 2200 is in interference fit with the inner sleeve 3200, to ensure that the inner sleeve 3200 can be firmly fixed on the auxiliary spray arm connecting sleeve 2200, ensuring that the ball assembly 3000 and the auxiliary spray arm 2000 can be reliably connected. Therefore, the ball assembly 3000 is connected to the main spray arm 1000 and the auxiliary spray arm 2000, which can ensure the reliable connection between the main spray arm 1000 and the auxiliary spray arm 2000, and the high working reliability of the main spray arm 1000 and the auxiliary spray arm 2000.

Based on the embodiment of FIG. 6, the ball assembly 3000 of the present disclosure may have many variations, and these variations fall within the protection scope of the present disclosure. Hereinafter, a plurality of variations of the ball assembly 3000 according to the embodiment of the present disclosure will be summarized in conjunction with FIG. 6.

In the first embodiment (not illustrated), the ball assembly 3000 may only include the balls 3400. That is, compared with the embodiment of FIG. 6, the outer sleeve 3100, the middle sleeve 3300, and the inner sleeve 3200 are omitted. The balls 3400 are directly used to cooperate with the main spray arm connecting sleeve 1200 and the auxiliary spray arm connecting sleeve 2200, which can also realize the rolling connection between the main spray arm connecting sleeve 1200 and the auxiliary spray arm connecting sleeve 2200. At this time, an inner peripheral surface of the main spray arm connecting sleeve 1200 is provided with a main spray arm ball groove suitable for cooperating with the balls 3400, and an outer peripheral surface of the auxiliary spray arm connecting sleeve 2200 is provided with an auxiliary spray arm ball groove suitable for cooperating with the balls 3400.

In the second embodiment (not illustrated), the ball assembly 3000 may only include the balls 3400 and the inner sleeve 3200. That is, compared with the embodiment of FIG. 6, the middle sleeve 3300 and the outer sleeve 3100 are omitted. The balls 3400 are directly used to cooperate with the inner sleeve 3200 and the main spray arm connecting sleeve 1200, which can also realize the rolling connection between the main spray arm connecting sleeve 1200 and the auxiliary spray arm connecting sleeve 2200. At this time, an inner peripheral surface of the main spray arm connecting sleeve 1200 is provided with a main spray arm ball groove suitable for cooperating with the balls 3400.

In the third embodiment (not illustrated), the ball assembly 3000 may only include the balls 3400 and the outer sleeve 3100. That is, compared with the embodiment of FIG. 6, the middle sleeve 3300 and the inner sleeve 3300 are omitted. The balls 3400 are directly used to cooperate with the auxiliary spray arm connecting sleeve 2200 and the outer sleeve 3100, which can also realize the rolling connection between the main spray arm connecting sleeve 1200 and the auxiliary spray arm connecting sleeve 2200. At this time, an outer peripheral surface of the auxiliary spray arm connecting sleeve 2200 is provided with an auxiliary spray arm ball groove suitable for cooperating with the balls 3400.

In the fourth embodiment (not illustrated), the ball assembly 3000 may only include the balls 3400, the inner sleeve 3200, and the outer sleeve 3100. That is, compared with the embodiment of FIG. 6, the middle sleeve 3300 is omitted. The balls 3400 are directly used to cooperate with the inner sleeve 3200 and the outer sleeve 3100, which can also realize the rolling connection between the main spray arm connecting sleeve 1200 and the auxiliary spray arm connecting sleeve 2200. At this time, the outer sleeve 3100 can be interference fit with the main spray arm connecting sleeve 1200, and the inner sleeve 3200 can be interference fit with the auxiliary spray arm connecting sleeve 2200.

In the fifth embodiment (not illustrated), the ball assembly 3000 may only include the balls 3400 and the middle sleeve 3300. That is, compared with the embodiment of FIG. 6, the inner sleeve 3200 and the outer sleeve 3100 are omitted. The balls 3400 are directly used to cooperate with the main spray arm connecting sleeve 1200 and the auxiliary spray arm connecting sleeve 2200, which can also realize the rolling connection between the main spray arm connecting sleeve 1200 and the auxiliary spray arm connecting sleeve 2200. At this time, an inner peripheral surface of the main spray arm connecting sleeve 1200 is provided with a main spray arm ball groove suitable for cooperating with the balls 3400, and an outer peripheral surface of the auxiliary spray arm connecting sleeve 2200 is provided with an auxiliary spray arm ball groove suitable for cooperating with the balls 3400.

In the sixth embodiment (not illustrated), the ball assembly 3000 may only include the balls 3400, the inner sleeve 3200, and the middle sleeve 3300. That is, compared with the embodiment of FIG. 6, the outer sleeve 3100 is omitted. The balls 3400 are directly used to cooperate with the inner sleeve 3200 and the main spray arm connecting sleeve 1200, which can also realize the rolling connection between the main spray arm connecting sleeve 1200 and the auxiliary spray arm connecting sleeve 2200. At this time, an inner peripheral surface of the main spray arm connecting sleeve 1200 is provided with a main spray arm ball groove suitable for cooperating with the balls 3400.

In the seventh embodiment (not illustrated), the ball assembly 3000 may only include the balls 3400, the outer sleeve 3100, and the middle sleeve 3300. That is, compared with the embodiment of FIG. 6, the inner sleeve 3200 is omitted. The balls 3400 are directly used to cooperate with the auxiliary spray arm connecting sleeve 2200 and the outer sleeve 3100, which can also realize the rolling connection between the main spray arm connecting sleeve 1200 and the auxiliary spray arm connecting sleeve 2200. At this time, an outer peripheral surface of the auxiliary spray arm connecting sleeve 2200 is provided with an auxiliary spray arm ball groove suitable for cooperating with the balls 3400.

In one embodiment, the auxiliary spray arm connecting sleeve 2200 can also be fitted over the main spray arm connecting sleeve 1200. At this time, an inner side of the ball assembly 3000 is in contact with the main spray arm connecting sleeve 1200, and an outer side of the ball assembly 3000 is in contact with the auxiliary spray arm connecting sleeve 2200. The situation in which the auxiliary spray arm connecting sleeve 2200 is fitted over the main spray arm connecting sleeve 1200 is similar to the above seven embodiments, and will not be repeated here.

In some embodiments, the ball assembly 3000 has a height of 5 mm to 25 mm. On the one hand, the ball assembly 3000 should have a height to ensure that its load capacity meets the requirements of the present disclosure (for example, 50 N), so a minimum height of the ball assembly 3000 is 5 mm. On the other hand, when a distance between the main spray arm 1000 and the auxiliary spray arm 2000 is large, the spray arm 10000 will interfere with internal parts of the dishwasher and reduce the loading capacity, so a maximum height of the ball assembly 3000 is 25 mm. Thus, the heights of the main spray arm connecting sleeve 1200 and the auxiliary spray arm connecting sleeve 2200 can be reduced, the distance between the main spray arm 1000 and the auxiliary spray arm 2000 can also be decreased, and hence the overall height of the spray arm 10000 can be reduced. In one embodiment, the height of the ball assembly 3000 may be 10 mm, 15 mm, 20 mm, 22 mm, etc.

Further, the auxiliary spray arm 2000 may include: a first spray arm 2300 and a second spray arm 2400. The auxiliary chamber 2101 may include: a first chamber 2301 within the first spray arm 2300 and a second chamber 2401 within the second spray arm 2400. That is, in the embodiment shown in FIGS. 1, and 3-5, the number of auxiliary spray arms 2000 is two, namely the first spray arm 2300 and the second spray arm 2400. The first spray arm 2300 and the second spray arm 2400 are arranged above the main spray arm 1000. In one embodiment, the first spray arm 2300 may be located at the upper left of the main spray arm 1000, and the second spray arm 2400 may be located at the upper right of the main spray arm 1000. Similarly, the first spray arm 2300 can also be located at the upper right of the main spray arm 1000, and the second spray arm 2400 can also be located at the upper left of the main spray arm 1000. For the convenience of description, the structures of the first spray arm 2300 and the second spray arm 2400 are explained by an example where the first spray arm 2300 may be located at the upper left of the main spray arm 1000, and the second spray arm 2400 may be located at the upper right of the main spray arm 1000.

The first spray arm 2300 is provided with the first chamber 2301 therein, and the second spray arm 2400 is provided with the second chamber 2401 therein, to ensure that both the first spray arm 2300 and the second spray arm 2400 can retain an amount of water, which can ensure that the first spray arm 2300 and the second spray arm 2400 work normally.

It should be noted that, terms such as "first" and "second" are used herein for purposes of description and are not intended to indicate or imply relative importance or significance or to imply the number of indicated features. Thus, the feature defined with "first" and "second" may explicitly or implicitly comprise one or more this feature. In the description of the present disclosure, "a plurality of" means at least two, for example, two, three, and etc., unless specified otherwise.

As illustrated in FIG. 1, the main spray arm 1000 may include: a main spray arm body 1100, a main spray arm first connecting sleeve 1210, and a main spray arm second connecting sleeve 1220. The main spray arm first connecting sleeve 1210 and the main spray arm second connecting sleeve 1220 are arranged on a common side of the main spray arm body 1100. That is, the main spray arm first connecting sleeve 1210 and the main spray arm second connecting sleeve 1220 are both arranged above the main spray arm body 1100.

In a specific embodiment, the main spray arm first connecting sleeve 1210 is configured to be connected with the first spray arm connecting sleeve 2310, and the main spray arm second connecting sleeve 1220 is configured to be connected with the second spray arm connecting sleeve 2410, to ensure that the first spray arm 2300 and the second spray arm 2400 can be connected to the main spray arm 1000. The main spray arm body 1100, the main spray arm first connecting sleeve 1210, and the main spray arm second connecting sleeve 1220 have a communicating main chamber 1001 therein, so that the water in the main chamber 1001 can smoothly enter the first chamber 2301 and the second chamber 2401 through the main spray arm first connecting sleeve 1210 and the main spray arm second connecting sleeve 1220, to ensure normal working of the first spray arm 2300 and the second spray arm 2400.

Referring to FIG. 5, the first spray arm 2300 may include: a first spray arm body 2320 and a first spray arm connecting sleeve 2310. The first spray arm connecting sleeve 2310 is disposed on a side of the first spray arm body 2320 facing the main spray arm 1000. That is, the first spray arm connecting sleeve 2310 is located below the first spray arm body 2320. The first spray arm body 2320 and the first spray arm connecting sleeve 2310 have a communicating first chamber 2301. In a specific embodiment, the first spray arm connecting sleeve 2310 can be connected with the main spray arm first connecting sleeve 1210 on a left side of the main spray arm 1000, to ensure the connection between the first spray arm 2300 and the main spray arm 1000. Since the first chamber 2301 is in communication with the main chamber 1001, the water in the main chamber 1001 can smoothly enter the first chamber 2301.

The ball assembly 3000 is arranged at the position where the first spray arm connecting sleeve 2310 is connected to and cooperates with the main spray arm first connecting sleeve 1210, to ensure that when the first spray arm 2300 rotates relative to the main spray arm 1000, the friction between the first spray arm 2300 and the main spray arm 1000 is rolling friction, which can reduce hydrodynamic loss and ensure high working stability of the first spray arm 2300.

As shown in FIG. 5, the second spray arm 2400 may include: a second spray arm body 2420 and a second spray arm connecting sleeve 2410. The second spray arm connecting sleeve 2410 is disposed on a side of the second spray arm body 2420 facing the main spray arm 1000. That is, the second spray arm connecting sleeve 2410 is located below the second spray arm body 2420. The second spray arm body 2420 and the second spray arm connecting sleeve 2410 have a communicating second chamber 2401. In a specific embodiment, the second spray arm connecting sleeve 2410 can be connected with the main spray arm second connecting sleeve 1220 on a right side of the main spray arm 1000, to ensure the connection between the second spray arm 2400 and the main spray arm 1000. Since the second chamber 2401 is in communication with the main chamber 1001, the water in the main chamber 1001 can smoothly enter the second chamber 2401.

The ball assembly 3000 is arranged at the position where the second spray arm connecting sleeve 2410 is connected to and cooperates with the main spray arm second connecting sleeve 1220, to ensure that when the second spray arm 2400 rotates relative to the main spray arm 1000, the friction between the second spray arm 2400 and the main spray arm 1000 is rolling friction, which can reduce hydrodynamic loss and ensure high working stability of the second spray arm 2400.

In one embodiment, the main spray arm first connecting sleeve 1210 and the main spray arm second connecting sleeve 1220 are symmetrical with respect to the main spray arm lower connecting sleeve 1300, to ensure that the first spray arm 2300 and the second spray arm 2400 are symmetrical about the main spray arm lower connecting sleeve 1300. Thus, it can be ensured that pressure of the first spray arm 2300 and pressure the second spray arm 2400 exerted on the main spray arm 1000 are symmetrical on an axis of the main spray arm lower connecting sleeve 1300, to guarantee the working stability of the spray arm 10000. The symmetrical design is not only beautiful, but also makes it easy to assemble and disassemble as there is no difference between the first spray arm 2300 and the second spray arm 2400.

Figure 3:
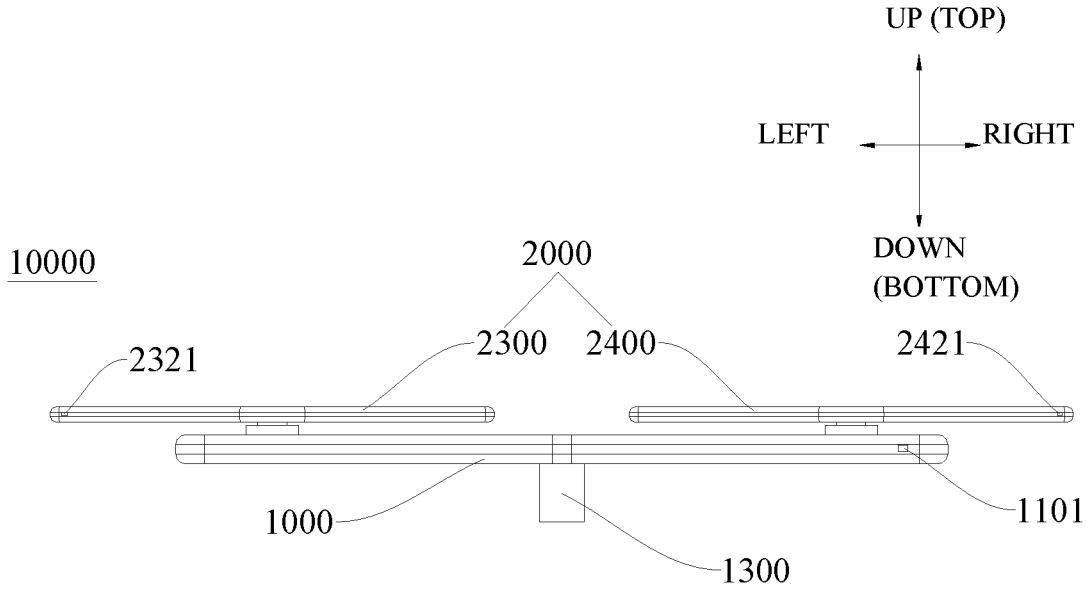
FIG. 3 is a front view of a spray arm.

As shown in FIGS. 1, 3, and 5, the first spray arm 2300 is provided with a first drive hole 2321 configured to drive the first spray arm 2300 to rotate in a first direction, and the first drive hole 2321 is in communication with the first chamber 2301, which ensures that the water jet in the first chamber 2301 can be sprayed from the first drive hole 2321. When the water jet inside the first spray arm 2300 is sprayed from the first drive hole 2321, the first spray arm 2300 will be subject to a counterforce (i.e., a reverse drive force) when the water jet is sprayed from the first drive hole 2321. At this time, the first spray arm 2300 rotates in the first direction under the action of the counterforce. The first direction is opposite to an opening direction of the first drive hole 2321. As the water jet is continuously sprayed from the first drive hole 2321, the first spray arm 2300 can continuously rotate, and the water jet sprayed from the first drive hole 2321 will be sprayed around along with the rotation of the first spray arm 2300. The water jet from the spray hole of the first spray arm 2300 also enters a working area of the dishwasher, and the water jets from the two kinds of holes cooperate to clear away stains on the tableware in the dishwasher or the inner wall of the dishwasher.

The second spray arm 2400 is provided with a second drive hole 2421 configured to drive the second spray arm 2400 to rotate in a second direction, and the second drive hole 2421 is in communication with the second chamber 2401, which ensures that the water jet in the second chamber 2401 can be sprayed from the second drive hole 2421. When the water jet is sprayed from the second drive hole 2421, the second spray arm 2400 will be subject to a counterforce when the water jet is sprayed from the second drive hole 2421. At this time, the second spray arm 2400 will rotate in the second direction under the action of the counterforce. The second direction is opposite to an opening direction of the second drive hole 2421. As the water is continuously sprayed from the second drive hole 2421, the second spray arm 2400 can continuously rotate, and the water jet sprayed from the second drive hole 2421 will be sprayed around along with the rotation of the second spray arm 2400. The water sprayed from the spray hole of the second spray arm 2400 also enters the working area of the dishwasher, so that the second spray arm 2400 and the first spray arm 2300 cooperate to clear away stains on the tableware in the dishwasher or the inner wall of the dishwasher.

At the same end of the first spray arm body 2320 and the second spray arm body 2420, the directions of the first drive hole 2321 and the second drive hole 2421 are opposite to ensure that the rotation directions of the first spray arm 2300 and the second spray arm 2400 are opposite. That is, the first direction is opposite to the second direction. In one embodiment, the first spray arm 2300 can rotate counterclockwise, and the second spray arm 2400 can rotate clockwise. In some embodiments (not illustrated), the first spray arm 2300 can rotate clockwise, and the second spray arm 2400 can rotate counterclockwise, in which case the water jets from the first drive hole 2321 of the first spray arm 2300 and the second drive hole 2421 of the second spray arm 2400 are sprayed in opposite directions. When the water jets sprayed from the first drive hole 2321 and the second drive hole 2421 fall on the tableware or the inner wall of dishwasher at the same time, due to inconsistent washing directions of the water jets applied to the tableware or the inner wall of dishwasher, the sprayed water jets from the first drive hole 2321 and the second drive hole 2421 produce a rubbing force on the tableware or the inner wall of dishwasher, which can enhance the cleaning effect of the spray arm 10000 and ensure that the tableware or the inner wall of dishwasher is cleaned. In addition, the reverse rotation of the first spray arm 2300 and the second spray arm 2400 can also cause the water sprayed from the spray hole of the first spray arm 2300 and the water sprayed from the spray hole of the second spray arm 2400 to produce a rubbing force on the tableware or the inner wall of dishwasher, further improving the cleaning effect of the spray arm 10000.

The main spray arm 1000 is provided with a main drive hole 1101 configured to drive the main spray arm 1000 to rotate in the first direction or the second direction. That is, by changing the orientation of the main drive hole 1101, the rotation direction of the main spray arm 1000 can be changed, to make the main spray arm 1000 rotate in the first direction or in the second direction. For the convenience of description, the working process of the main spray arm 1000 is described below by taking the rotation in the first direction as an example.

When the main spray arm 1000 rotates in a first direction, at the same end of the main spray arm 1000 and the first spray arm 2300, the orientations of the main drive hole 1101 and the first drive hole 2321 are the same. When the water jet inside the main spray arm 1000 is sprayed from the main drive hole 1101, the main spray arm 1000 will be subject to a counterforce (i.e., a reverse drive force) when the water jet is sprayed from the main drive hole 1101. At this time, the main spray arm 1000 rotates in a first direction under the action of the counterforce. The first direction is opposite to an opening direction of the main drive hole 1101. As the water jet is continuously sprayed from the main drive hole 1101, the main spray arm 1000 can continuously rotate, and the water jet sprayed from the main drive hole 1101 will be sprayed around along with the rotation of the main spray arm 1000. The water jet from the spray hole of the main spray arm 1000 also enters the working area of the dishwasher. The water jets from the two kinds of holes cooperate to clear away stains on the tableware in the dishwasher or the inner wall of the dishwasher. By providing the main spray arm 1000, it can supply water to the auxiliary spray arm 2000. Moreover, the main spray arm 1000 and the auxiliary spray arm 2000 can spray water simultaneously, which can further enhance the cleaning ability of the spray arm 10000 and ensure the working effect of the spray arm 10000.

In one embodiment, referring to FIG. 3, the first drive hole 2321 is arranged at an end of the first spray arm body 2320, the second drive hole 2421 is arranged at an end of the second spray arm body 2420, and the main drive hole 1101 is arranged at an end of the main spray arm 1000. Thus, it can be ensured that when water jets are sprayed from the first drive hole 2321, the second drive hole 2421 and the main drive hole 1101, a moment arm is long, which is beneficial to increase a driving torque of the first spray arm 2300, the spray arm 2400 and the main spray arm 1000. Hence, the first spray arm 2300, the spray arm 2400 and the main spray arm 1000 can have a relatively higher rotation speed, and the water jets sprayed from the first drive hole 2321, the second drive hole 2421 and the main drive hole 1101 and falling on the inner wall of the dishwasher and the tableware can have a greater beating force, which helps to improve the cleaning effect of the spray arm 10000.

In some optional embodiments, the first direction and the second direction may be the same. At this time, at the same end of the first spray arm body 2320 and the second spray arm body 2420, orientations of the first drive hole 2321 and the second drive hole 2421 are the same, and the first spray arm 2300 and the second spray arm 2400 rotate in the same direction, which can increase the water spray amount of the spray arm 10000 and improve the cleaning effect of the spray arm 10000. By changing the diameters of the first drive hole 2321 and the second drive hole 2421, a drive force of the first drive hole 2321 to the first spray arm 2300 and a drive force of the second drive hole 2421 to the second spray arm 2400 can be changed, changing the rotation speeds of the first spray arm 2300 and the second spray arm 2400, to enable the first spray arm 2300 and the second spray arm 2400 to rotate in the same direction at the same speed or rotate in the same direction at different speeds.

In one embodiment, the length of the first spray arm body 2320 is 0.5-1 times the length of the main spray arm body 1100, and the length of the second spray arm body 2420 is 0.5-1 times the length of the main spray arm body 1100. In other words, the lengths of the first spray arm body 2320 and the second spray arm body 2420 are both less than or equal to the length of the main spray arm body 1100. On the one hand, the first spray arm 2300 and the second spray arm 2400 are arranged at the same height above the main spray arm 1000, and the first spray arm 2300 and the second spray arm 2400 are both connected to the main spray arm 1000, so that the maximum lengths of the first spray arm body 2320 and the second spray arm body 2420 that can be set are equal to the length of the main spray arm body 1100. On the other hand, the first spray arm body 2320 and the second spray arm body 2420 are configured to be relatively short, which can reduce the weight of the first spray arm 2300 and the second spray arm 2400, ensuring that the first spray arm 2300 and the second spray arm 2400 can rotate smoothly, and the structure of the entire spray arm 10000 is relatively stable and will not be easily tipped over. In addition, the lengths of the first spray arm body 2320 and the second spray arm body 2420 are smaller than the length of the main spray arm body 1100, so that the volumes in the first chamber 2301 and the second chamber 2401 are smaller than the volume of the main chamber 1001. In a washing stage, most of the water flow preferentially enters the main chamber 1001, and the water pressure in the main chamber 1001 is relatively high, which can ensure that pressure of the water jet sprayed from the main spray arm 1000 is relatively large, and the main spray arm 1000 can rotate smoothly. By configuring the lengths of the first spray arm body 2320 and the second spray arm body 2420 to be shorter, the volumes of the first chamber 2301 and the second chamber 2401 can be reduced, ensuring sufficiently high water pressure in the first chamber 2301 and the second chamber 2401, to ensure that pressure of the water jets sprayed from the first spray arm 2300 and the second spray arm 2400 is relatively large, and hence the first spray arm 2300 and the second spray arm 2400 can rotate smoothly.

In some embodiments (not illustrated), the heights of the first spray arm 2300 and the second spray arm 2400 relative to the main spray arm 1000 are not equal. In one embodiment, the first spray arm body 2320 may be located above the second spray arm body 2420.

A washing appliance according to embodiments of another aspect of the present disclosure includes the spray arm 10000 described above. The washing appliance may be a dishwasher, a fruit and vegetable washing machine, a medical washing machine, and other washing appliances with washing functions, and can have a similar effect to the dishwasher with the spray arm 10000 arranged therein, which will not be repeated here.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of these phrases in various places throughout this specification are not necessarily referring to the same embodiment or example of the present disclosure. Furthermore, the particular features, structures, materials, or characteristics may be combined in any suitable manner in one or more embodiments or examples. Moreover, incorporation and combination of different embodiments and examples are described herein.

What is claimed is:

1. A spray arm apparatus, comprising:

a main spray arm comprising a plurality of main spray arm connecting sleeves;

a plurality of auxiliary spray arms, each auxiliary spray arm being connected to the main spray arm and rotatable relative to the main spray arm; and a ball assembly arranged at a position where each auxiliary spray arm is connected to and cooperates with the main spray arm;

wherein each auxiliary spray arm comprises an auxiliary spray arm body and an auxiliary spray arm connecting sleeve, the auxiliary spray arm connecting sleeve arranged on a side of the auxiliary spray arm body facing the main spray arm, and the ball assembly arranged at the position where the auxiliary spray arm connecting sleeve is connected to and cooperates with one of the main spray arm connecting sleeves.

2. The spray arm apparatus according to claim 1, wherein the main spray arm further comprises a main spray arm body, the plurality of main spray arm connecting sleeves arranged on a common side of the main spray arm body, and each auxiliary spray arm connected to the main spray arm through one of the main spray arm connecting sleeves.

3. The spray arm apparatus according to claim 1, wherein the ball assembly at least comprises a plurality of balls, and the plurality of balls rotatably cooperate between the auxiliary spray arm connecting sleeve and the main spray arm connecting sleeve.

4. The spray arm apparatus according to claim 3, wherein the ball assembly further comprises a bearing base, and the balls cooperate between the auxiliary spray arm connecting sleeve and the main spray arm connecting sleeve through the bearing base.

5. The spray arm apparatus according to claim 4, wherein the bearing base comprises:

an inner sleeve configured to be fitted with one of the auxiliary spray arm connecting sleeve and the main spray arm connecting sleeve;

a middle sleeve fitted over the inner sleeve, and provided with a plurality of ball holes, the balls being mounted in the ball holes, and the balls protruding beyond an inner peripheral surface and an outer peripheral surface of the middle sleeve in a radial direction of the middle sleeve; and an outer sleeve fitted over the middle sleeve, and configured to be fitted with the other of the auxiliary spray arm connecting sleeve and the main spray arm connecting sleeve.

6. The spray arm apparatus according to claim 5, wherein the inner sleeve is integrated with one of the auxiliary spray arm connecting sleeve and the main spray arm connecting sleeve, and the inner sleeve constitutes a part of the one of the auxiliary spray arm connecting sleeve and the main spray arm connecting sleeve; or the outer sleeve is integrated with the other of the auxiliary spray arm connecting sleeve and the main spray arm connecting sleeve, and the outer sleeve constitutes a part of the other of the auxiliary spray arm connecting sleeve and the main spray arm connecting sleeve.

7. The spray arm apparatus according to claim 5, wherein the inner sleeve is integrated with one of the auxiliary spray arm connecting sleeve and the main spray arm connecting sleeve, and the inner sleeve constitutes a part of the one of the auxiliary spray arm connecting sleeve and the main spray arm connecting sleeve; and the outer sleeve is integrated with the other of the auxiliary spray arm connecting sleeve and the main spray arm connecting sleeve, and the outer sleeve constitutes a part of the other of the auxiliary spray arm connecting sleeve and the main spray arm connecting sleeve.

8. The spray arm apparatus according to claim 5, wherein an inner peripheral surface of the outer sleeve is provided with an outer sleeve ball groove configured to cooperate with the balls; an outer peripheral surface of the inner sleeve is provided with an inner sleeve ball groove configured to cooperate with the balls; and the outer sleeve ball groove and the inner sleeve ball groove are both circumferentially annular grooves.

9. The spray arm apparatus according to claim 8, wherein the outer sleeve comprises: an outer sleeve peripheral wall and an outer sleeve top wall; the outer sleeve top wall is arranged on an end of the outer sleeve peripheral wall away from the main spray arm and extends inwardly along a radial direction of the outer sleeve peripheral wall; and the outer sleeve ball groove is arranged on an inner peripheral surface of the outer sleeve peripheral wall.

10. The spray arm apparatus according to claim 5, wherein the ball hole is arranged at a top of the middle sleeve; the ball hole is a major arc hole; and a top notch of the ball hole forms a ball fetching port.

11. The spray arm apparatus according to claim 10, wherein a weakening groove is arranged between two adjacent ball holes, and the weakening groove is provided with a weakening groove post therein.

12. The spray arm apparatus according to claim 4, wherein the bearing base comprises:

an inner sleeve configured to be fitted with one of the auxiliary spray arm connecting sleeve and the main spray arm connecting sleeve; and an outer sleeve configured to be fitted with the other of the auxiliary spray arm connecting sleeve and the main spray arm connecting sleeve.

13. The spray arm apparatus according to claim 3, wherein the balls are plastic balls or stainless steel balls.

14. The spray arm apparatus according to claim 1, wherein the auxiliary spray arm comprises a first spray arm and a second spray arm; the first spray arm is provided with a first drive hole configured to drive the first spray arm to rotate in a first direction; the second spray arm is provided with a second drive hole configured to drive the second spray arm to rotate in a second direction; the first direction and the second direction are consistent or opposite; and the main spray arm is provided with a main drive hole configured to drive the main spray arm to rotate in the first direction or the second direction.

15. The spray arm apparatus according to claim 14, wherein a length of the first spray arm is 0.5-1 times a length of the main spray arm body, and a length of the second spray arm is 0.5-1 times the length of the main spray arm body.

16. The spray arm apparatus according to claim 1, wherein the ball assembly has a height of 5 mm to 25 mm.

17. A washing appliance, comprising:

a spray arm apparatus, comprising:

a main spray arm comprising a plurality of main spray arm connecting sleeves;

a plurality of auxiliary spray arms, each auxiliary spray arm being connected to the main spray arm and rotatable relative to the main spray arm; and a ball assembly arranged at a position where each auxiliary spray arm is connected to and cooperates with the main spray arm;

wherein each auxiliary spray arm comprises an auxiliary spray arm body and an auxiliary spray arm connecting sleeve, the auxiliary spray arm connecting sleeve arranged on a side of the auxiliary spray arm body facing the main spray arm, and the ball assembly arranged at the position where the auxiliary spray arm connecting sleeve is connected to and cooperates with one of the main spray arm connecting sleeves.

18. The washing appliance according to claim 17, wherein the main spray arm further comprises a main spray arm body, the plurality of main spray arm connecting sleeves arranged on a common side of the main spray arm body, and each auxiliary spray arm connected to the main spray arm through one of the main spray arm connecting sleeves.

* * * * *